US007229185B1

(12) United States Patent
Galvez et al.

(10) Patent No.: US 7,229,185 B1
(45) Date of Patent: Jun. 12, 2007

(54) LIGHT SOURCE APPARATUS, WITH POSITIVE SUPPORT

(75) Inventors: James M. Galvez, San Dimas, CA (US); Matthew J. Galvez, Pasadena, CA (US)

(73) Assignee: National Electric Manufacturing Corporation, Commerce, CA (US)

( * ) Notice: Subject to any disclaimer, the term of this patent is extended or adjusted under 35 U.S.C. 154(b) by 11 days.

(21) Appl. No.: 11/027,950

(22) Filed: Jan. 4, 2005

(51) Int. Cl.
*F21V 33/00* (2006.01)

(52) U.S. Cl. ..... 362/109; 362/396; 362/397; 362/398

(58) Field of Classification Search ..... 362/109, 362/120, 183, 184, 190, 191, 285, 398, 396, 362/397, 399, 400, 220, 221, 222, 223, 185, 362/189, 418, 287, 376–378
See application file for complete search history.

(56) References Cited

U.S. PATENT DOCUMENTS

| | | | | |
|---|---|---|---|---|
| 4,672,515 | A * | 6/1987 | Baker | 362/398 |
| 4,897,768 | A * | 1/1990 | Thul | 362/191 |
| 5,170,332 | A * | 12/1992 | Browne | 362/376 |
| 5,568,968 | A * | 10/1996 | Jaramillo | 362/376 |
| 6,123,434 | A * | 9/2000 | Meltzer | 362/260 |
| 6,902,295 | B2 * | 6/2005 | Galvez | 362/222 |

* cited by examiner

*Primary Examiner*—Sandra O'Shea
*Assistant Examiner*—Bao Q. Truong
(74) *Attorney, Agent, or Firm*—William W. Haefliger

(57) ABSTRACT

A hand-held illuminator apparatus attachable to support structure, comprising an elongated body including a hand held section; a main light source carried by the body; circuitry in the body to supply electrical current to the light source; and at least one suction cup carried by the body to provide for positive releasable attachment of the apparatus to support structure.

27 Claims, 6 Drawing Sheets

LIGHT SOURCE APPARATUS, WITH POSITIVE SUPPORT

BACKGROUND OF THE INVENTION

This invention relates generally to the selective supporting of illumination apparatus, and more particularly to apparatus and methods to selectively support such equipment in relation to work to be illuminated. Typically, such support is to walls of vehicle engine compartments, as for example raised hoods of various vehicles.

At the present time, hood lights are provided with hooks which hook over protrusions or edges of or on engine compartment walls, to hang the light. This limits the direction of direct illumination, so that desired direct illumination of work may not be easily attained. There is need for enhanced accuracy of such directed illumination of work, obtainable in a ready and easy manner.

SUMMARY OF THE INVENTION

It is a major object of the invention to provide improved apparatus and methods, meeting the above need, as well as other needs, as will appear.

Basically, the invention is embodied in the combination that includes:

a) an elongated body including a hand held section, b) a main light source carried by the body, c) circuitry in said body to supply electrical current to the light source, d) and at least one suction cup carried by said body to provide for positive releasable attachment of said apparatus to support structure.

As will appear, the suction cup or cups may be selectively attached to the body in one of the following modes:

i) fixedly attached, ii) adjustably attached, iii) swingably attached, iv) detent attached.

Another object is to provide a transparent lens carried by the body to pass generated light to the body exterior, and in a first direction, the suction cup faces in a second direction which is generally opposite to said first direction; and the body is typically elongated, the suction cup or cups facing laterally.

In its method aspects, the invention includes the step of adjusting at least one suction cup relative to an elongated axis defined by the body and relative to said support structure to support gravitational forces exerted via said body to prevent inadvertent detachment of the body from said support structure. That adjusting step typically includes adjusting the position of the cup both lengthwise of and about said elongated axis.

Further, the circuitry within the body typically includes ballast or other weight positioned in or on said body to exert force acting on the cup when the body is attached via the cup to the support structure, and the adjusting step includes adjusting the position of the cup relative to such weight to prevent detachment of the body from the support structure when light is directed on work. This support structure typically comprises the raised hood of a vehicle to which the body is attached via the suction cup, or window glass.

A further step of the method may typically includes adjusting the apparatus body both longitudinally and about the elongated axis, and relative to the suction cup attached to the support structure, to effect needed accurate illumination of work. In addition ballast may include multiple ballast sections spaced lengthwise of the body to exert gravitational forces at multiple locations, as for example magnetic ballast, and said adjusting step includes adjusting the position of the cup relative to both ballast sections to prevent cup detachment. Non-magnetic ballast may be used.

These and other objects and advantages of the invention, as well as the detail of an illustrative embodiment, will be more fully understood from the following specification and drawings, in which:

DRAWING DESCRIPTION

DETAILED DESCRIPTION

Figure 7:
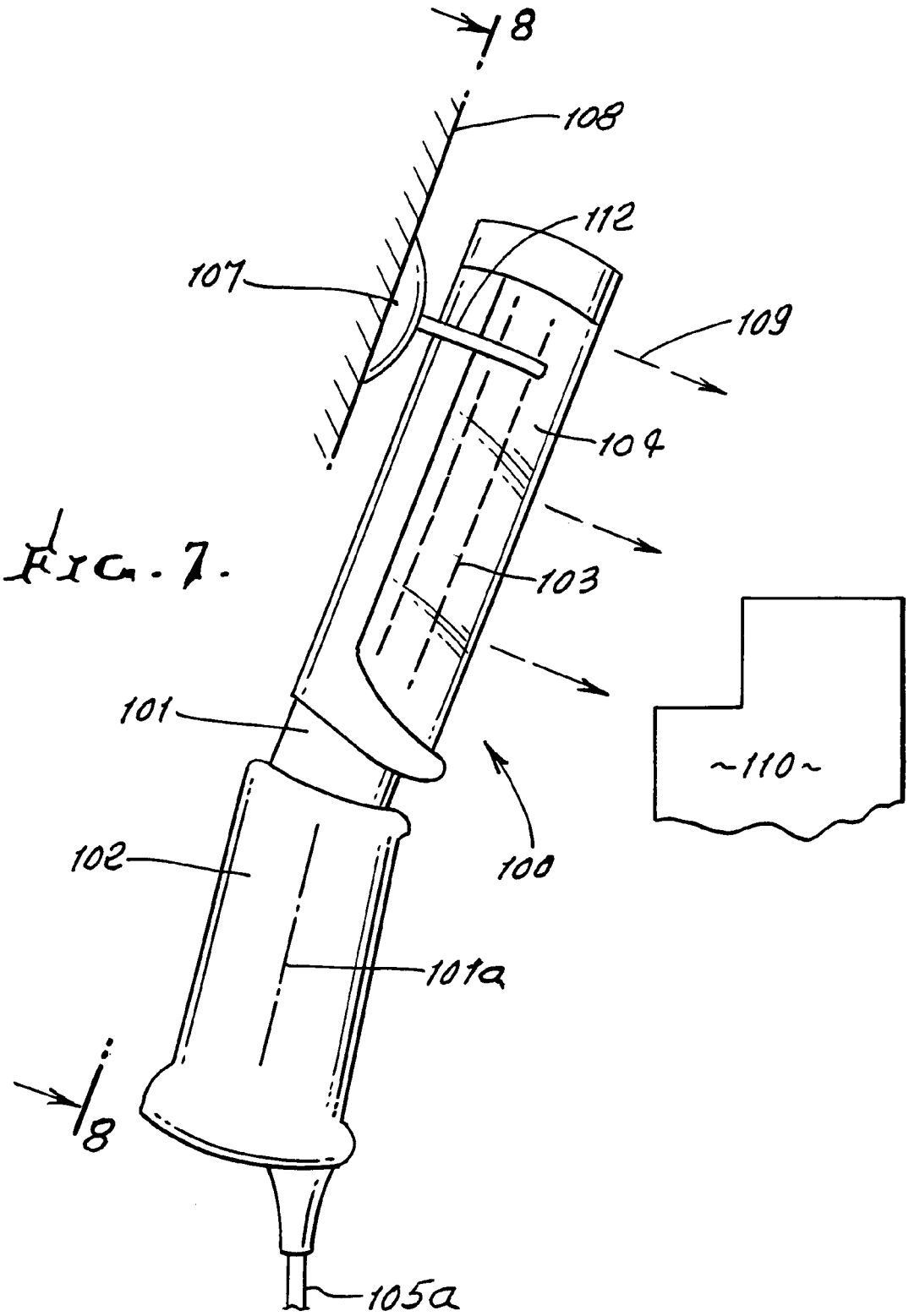
FIG. 7 is a side view showing a representative hood light outline with suction cup attached, other hood lights being usable.
Figure 8:
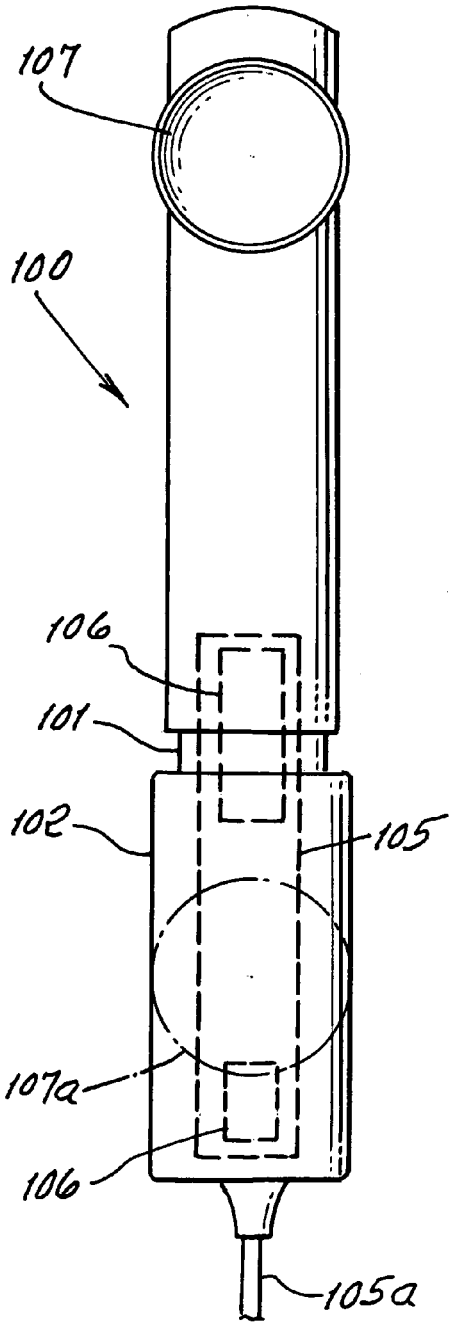
FIG. 8 is a rear elevation taken on lines 7—7 of FIG. 7.

Referring first to FIGS. 7 and 8, they show preferred, generalized, hand-held illuminator apparatus 100 having:

a) an elongated body housing 101 including a hand held section 102;

b) a main light source 103, such as between 1 and 4 elongated fluorescent bulbs, or multiple LEDs, carried by the body to face laterally toward light transmission lens 104;

c) and circuitry indicated at 105 carried in the body to supply electrical current to the light source.

An electrical power source cable 105*a* may be connected to the body, to supply current to 105. That circuitry may typically include ballast, which is magnetic and exerts weight on the body. Two spaced ballast sections 106 may be used.

In accordance with the invention, at least one suction cup 107 is carried by the body for positive releasable attachment of the apparatus to support structure 108 which may comprise an elevated hood, to cover a vehicle engine compartment. Structure 108 may comprise window glass, or a painted vehicle surface. The suction cup is positioned on the body, and is suction attached to the hood (for example) to position the body for light transmission as at 109 to most effectively and directly illuminate work 110, such as engine components. In use, the suction cup is adjusted relative to the body, and to its elongated axis 101*a*, and also relative to the hood (or other support structures) to support weight (gravitational forces) exerted via the body, to prevent inadvertent detachment of the body from the support structure as during work on the engine or other mechanism, while at the same time enabling most effective direct illumination of that work.

The adjusting step typically includes adjusting the position of said cup both lengthwise of and about said elongated axis.

FIG. 8 shows an alternate position 107*a* of cup 107, between and offset from the ballast sections 106 to enable angled support of the body relative to the hood, or window glass, with reduced gravitational torque exerted on the body. Two suction cups can be used, as at 107 and 107*a*, and 107 or 107*a* may represent a magnetic pad, to magnetically connect to hood structures.

Figure 9:
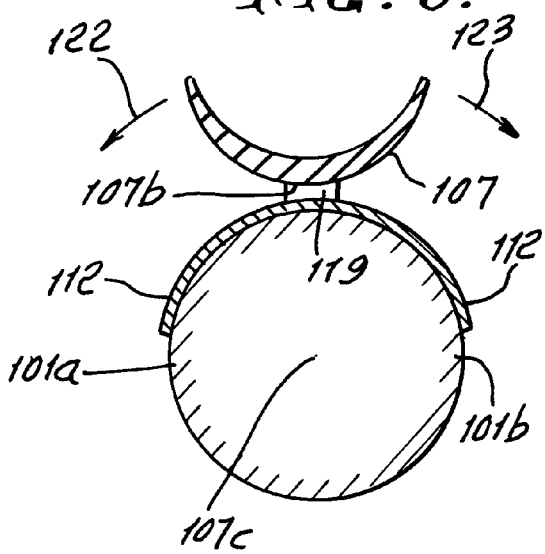
FIG. 9 is a section showing one mode of suction cup attachment to the illuminator body.

Referring to FIG. 9, it shows suction cup 107 carried by two arcuate holders or legs 112 extending from or near the base 107*b* of the cup, and oppositely at opposite sides 101*a* and 101*b* of the housing or body, to resiliently and adjustably firmly grip the body for holding the cup to the body in selected positions. Those legs can be frictionally adjusted in position relative to the body, as in rotary directions 122 and 123 about axis 107*c*, and also lengthwise of the axis, to best position the body and the light source, relative to the work, for example prior to suction application of the cup to the support structure. Also, after such suction application, the body or housing can then be further adjusted, in directions 122 and 123 (see FIG. 9), and also lengthwise of the body axis 107*c*, to "fine tune" the position of the housing and light source for best application to different areas or zones of the work being handled. This mode of adjustment clearly has many effective advantages over the prior one position hook hang supporting of a work light. For example, weight or torque exerted by or via the housing, as from heavy ballast (indicated at 106) contained within the housing, is accommodated as by adjustment shifting of the housing 101 axially, to locate the center of gravity of the apparatus closer to the suction cup already attached to the raised hood of the vehicle; and the housing 101 can be rotated relative to the suction cup as via a bearing 119, and against friction exerted by the bearing to angularly position the light source most effectively as respects the work.

Figure 10:
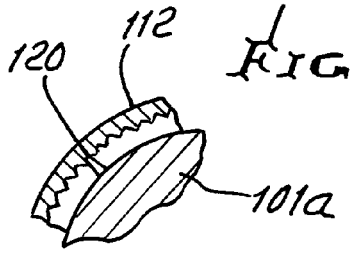
FIG. 10 is a section showing another mode of cup attachment to the body, and which is preferred.

FIG. 10 shows detent connection at 120 of one of the legs 112 to the body or housing, to allow rotating adjustment and positive detent retention of the legs and suction cup relative to the body 101.

Figure 11:
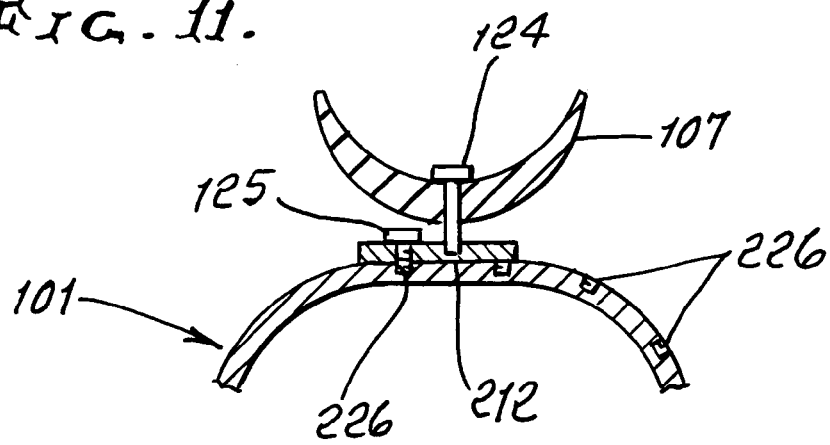
FIG. 11 is like FIG. 4, but showing detent attachment of the suction cup to the body.

FIG. 11 shows a base or leg 212 carrying the suction cup at 124, that base or leg 212 having selective connection to the body 101 as via a threaded fastener 125 extending through 212 and a selected threaded recess 226 in the body. Multiple such recesses 226 are shown, spaced about axis 107*c*, to allow adjustment of 107 about that axis.

Figure 12:
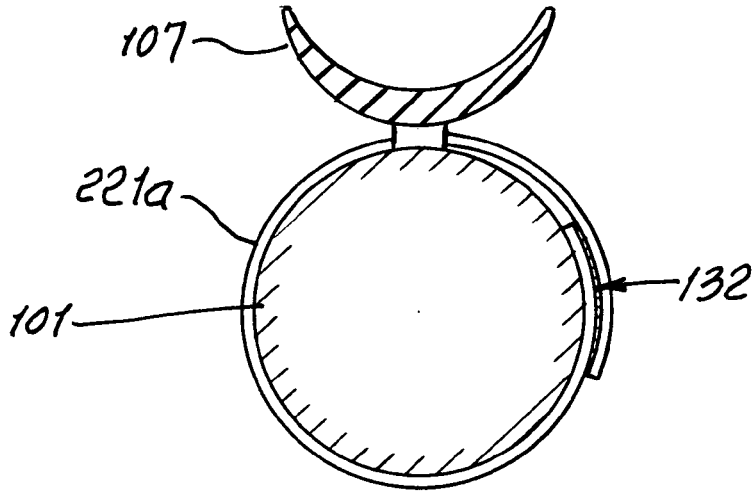
FIG. 12 is like FIG. 7 but showing grip band attachment of the cup to the body.

FIG. 12 shows the legs 212*a* in the form of flexible band material, wrapping about body 101, and releasably interconnected at 132. Such legs may comprise resiliently stretchable VELCRO material, for example.

FIGS. 1–6 show a suction cup 107, as described, easily applied, and adjustably supported by, to a known or preexisting hood light 10, having two sections 10*a* and 10*b*. See arms 112 attached to the cup, and extending about body section 10*b*. Section 10*a* is lengthwise elongated and has an inwardly sunk outwardly convex, elongated hand grip surface portion 11 between end flanges 12 and 13. Arcuate protuberances 11*a* project outwardly from 11, and are spaced lengthwise of 10*a* to provide finger grippable subsurfaces. An electrical cord 14 extends to the end of section 10*a*, to supply electrical current to ballast circuitry housed within 10*a*. An alternative electrical plug is shown at 14*a*.

Section 10*b* of the device 10 is elongated and extends endwise relative to section 10*a*, the directions of elongation of the sections 10*a* and 10*b* respectively indicated by arrows 15*a* and 15*b*. Arrow 15*b* is canted relative to arrow 15*a*, and at angle α, where α is between 50 and 15°, enhancing illumination utility of the device, as in difficult to access work spaces.

The drawings also show an elongated lens 20 assembled to the second section 10*b*, and in such a way as to have hinge support at 21, proximate one end of the elongated lens. Note the lens carrier 22 projecting away from the lens, and having a smooth convex surface at 22*a*. Carrier fits between two like laterally projecting supports 23 and 24 respectively located on the forwardly jutting portions 25*a* and 26*a* of two L-shaped arms 25 and 26. Portions 25*a* and 26*a* have curvature closely matching lens curvature. Those arms have edge portions 25*b* and 25*c*, and 26*b* and 26*c* bounding the lens 20 at spaced locations along its length, and along the lower extent of its U-shaped configuration, as shown. As the lens is pivoted away from arms 25 and 26 about the axis of the hinged support 21, its edge portions move away form the protective L-shaped arms. The closed lens is protected from impact with other objects or surfaces, by U-shaped bumper 30 extending about the U-shaped upper end extent of the lens, and by the sidewardly jutting arm portions 25*a* and 26*a* and structure 23 and 24. Protective arms 25 and 26 may be considered as parts of the upper section 10*b*. An identification latch is applied, at 90°.

Arms 25 and 26 are also curved, along their lengths, to extend at 25*d* and 26*d* to extend at the rear side of the lens, and protect the elongated fluorescent bulb or bulbs 36 within the interior of 10*b*, and facing the lens. When the lens is pivoted forwardly, and clockwise in FIG. 4, to give access to the interior of 10*b*, from the top right, the bulb or bulbs can be easily removed and replaced, without complete removal of the lens. The lens may thereafter be easily closed back into FIG. 4 position, fitting to protective arms 25 and 26.

Figure 3:
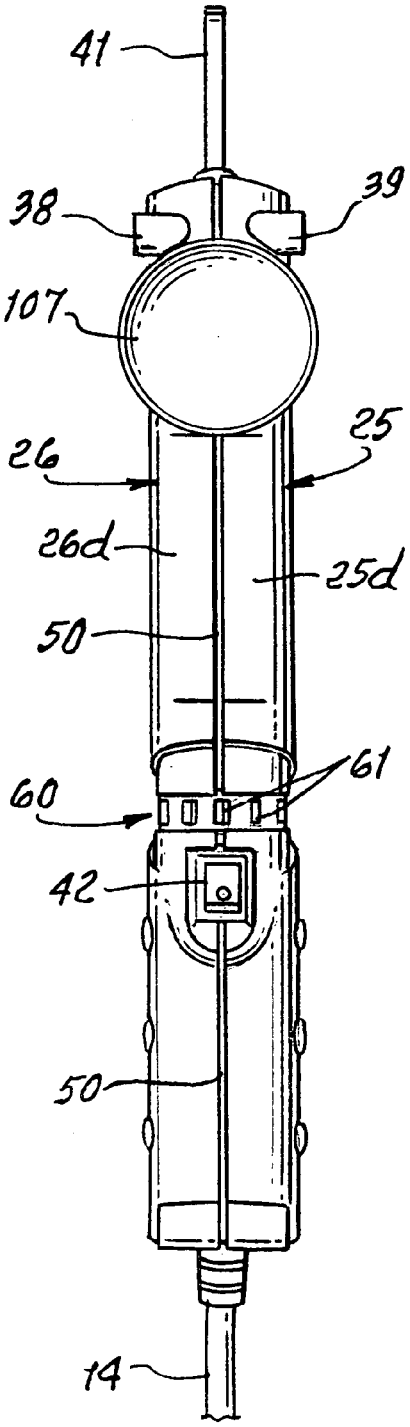
FIG. 3 is an elevation view showing the rear side of the FIG. 1 device.
Figure 4:
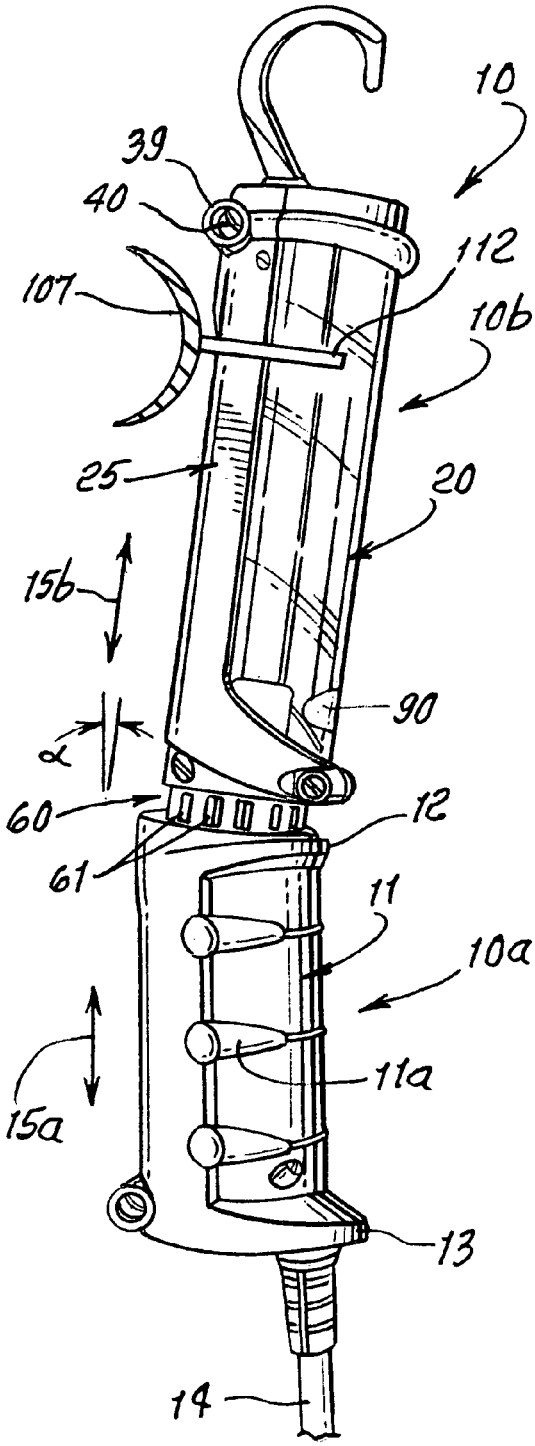
FIG. 4 is a left side elevation view of the FIG. 1 device.
Figure 5:
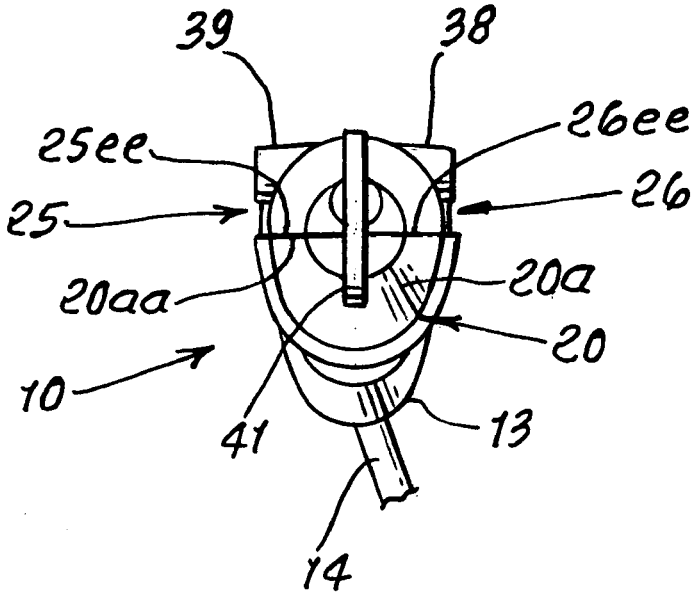
FIG. 5 is a top plan view of the FIG. 1 device.
Figure 6:
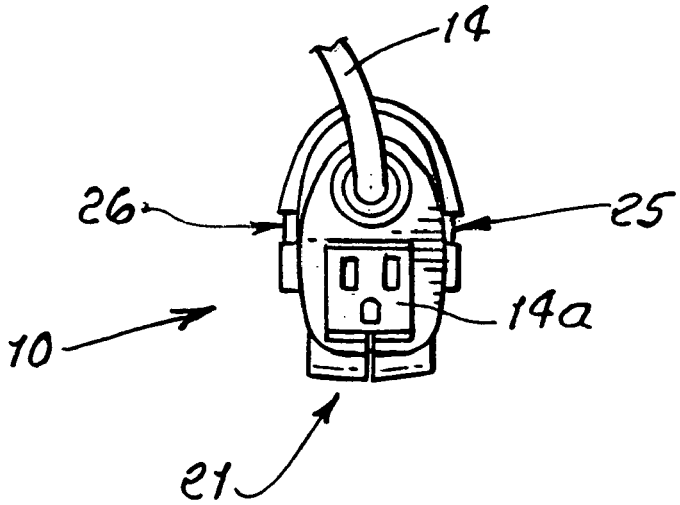
FIG. 6 is a bottom plan view of the FIG. 1 device.

The two arms 25 and 26 may be held in FIGS. 3 and 4 position, by a fastener 40 inserted through aligned retainers 38 and 39 integral with the upper extents of the arms, and in or close to the plane of curved bumper 30. The top 20*a* of the lens has a transverse edge 20*aa* which meets transverse edges 25*ee* and 26*ee* of the tops 25*e* and 26*e* of the arms. See FIG. 5.

The obtuse interior angle formed by and between the two sections 10*a* and 10*b*, serves to protect the hinging zone between the sections, as in case of dropping of the device.

An ON-OFF switch is seen at 42; and a device auxiliary support or hinging hook 41 protrudes from the end of upper section 10*b*, formed by upper ends of arms 52 and 26.

The relatively angled direction of elongation, at the axes of sections 10*a* and 10*b*, define a plane 50 which bisects the lens, lengthwise thereof. The lens has U-shaped curvature along its length, which remains intersected by the plane, as the lens swings with jaw-like movement about said hinge support. That plane 50 also bisects the lens hinged support. See FIG. 2.

A cylindrical connection 60 extends between and supports sections 10*a* and 10*b*. It has detent ribs 61 spaced about its surface, to engage a holder for rotatably supporting auxiliary equipment, with adjustable detent action auxiliary equipment. Connection 60 has reduced and exposed diameter relative to sections 10*a* and 10*b*, whereby such rotatable auxiliary equipment is retained endwise between 10*a* and 10*b*, in adjustably rotated position.

The following claims are intended to cover the structure as variously shown in the drawings, and equivalents thereof, i.e. operating in generally the same or similar way or ways.

Figure 1:
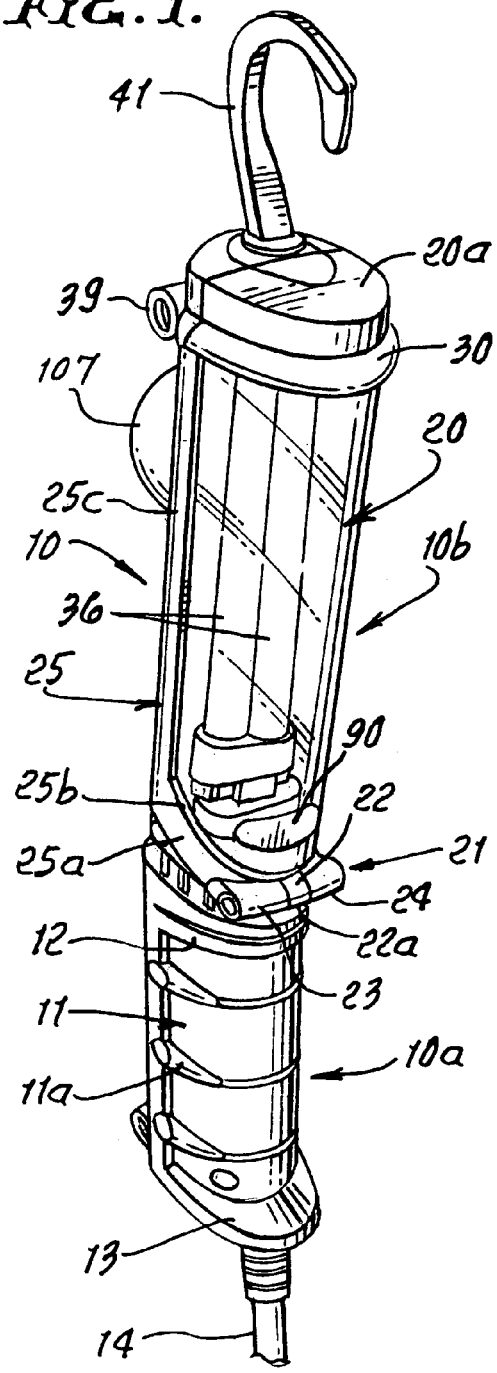
FIG. 1 is a perspective view showing an illumination device in more detail and carrying a suction cup.
Figure 2:
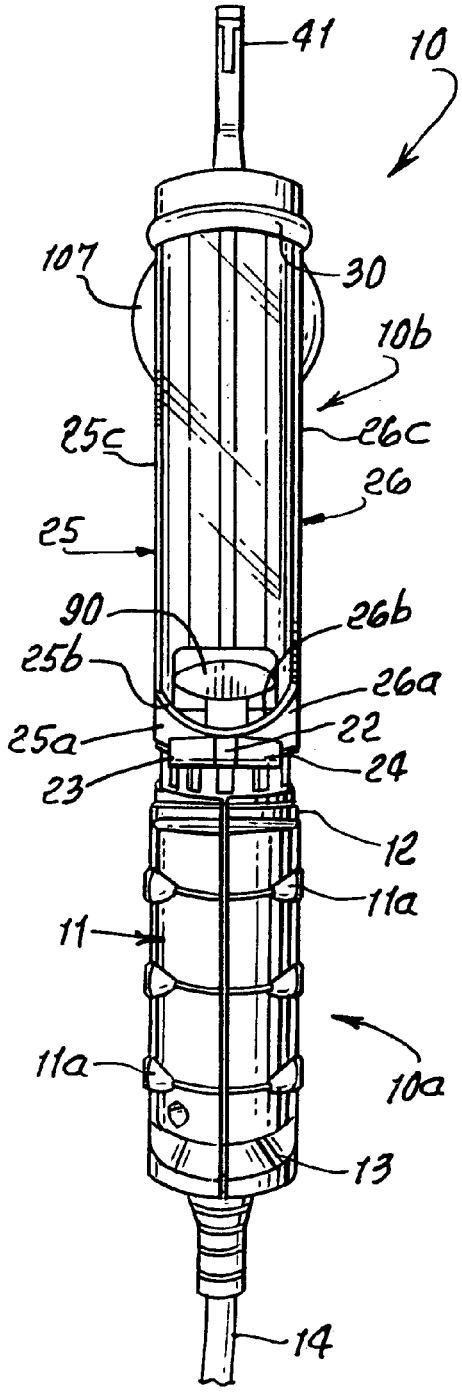
FIG. 2 is an elevation view showing the front side of the FIG. 1 device.

From the foregoing, it will be understood that the lens in FIGS. 1 and 2, and other figures has an exterior elongated surface which has generally circular curvature in cross sections normal to the direction of lens elongation. Also, the cup support means includes legs extending generally oppositely at least part way about the lens and body from a locus at base extent of the cup. Also, the method of attaching the illuminator to support structure includes providing for relative rotation of the body relative to the suction cup about an elongated axis defined by the body, and for shifting of the body in the direction of said axis and relative to the body.

We claim:

1. A hand-held illuminator apparatus attachable to support structure, comprising in combination:

a) an elongated body including a hand held section, b) a main light source carried by the body, c) circuitry in said body to supply electrical current to the light source, d) and at least one suction cup carried by said body to provide for positive releasable attachment of said apparatus to support structure, e) and including a transparent lens carried by the body to pass generated light away from the body, and in a first direction, the suction cup facing in a second direction which is generally opposite to said first direction, f) said lens having an exterior elongated surface which has generally circular curvature in cross sections normal to the direction of lens elongation, g) and suction cup support means embracing said body and lens circular curvature, whereby the lens and body may be rotated relative to said cup, which is located adjacent the lens.

2. The combination of claim 1 wherein the suction cup is attached to said body in one of the following modes:

i) fixedly attached, ii) adjustably attached, iii) swingably attached, iv) detent attached.

3. The combination of claim 1 wherein a recess is provided on the body to receive attachment means attaching the suction cup to the body.

4. The combination of claim 1 wherein said body is longitudinally elongated, and said suction cup faces laterally.

5. The combination of claim 1 wherein the main light source includes at least one of the following:

i) a light bulb, ii) multiple LEDs.

6. The combination of claim 5 wherein said cup support means includes legs extending generally oppositely at least part way about the lens and body from a locus at base extent of the cup.

7. The combination of claim 1 including a magnetic device on the body, in spaced relation to the suction cup, and in one of the following forms:

i) a telescopically supported magnet, ii) a magnetic pad.

8. The combination of claim 7 wherein said pad is carried on said hand held section to face away from the body, to extend at a lower elevation when the illuminator is suspended by said suction cup.

9. The combination of claim 2 wherein said suction cup is detachably carried by the body.

10. The combination of claim 2 including a light window defined by the body to pass light generally in the direction away from which the suction cup faces.

11. The combination of claim 6 wherein the lens is swingably mounted to swing away from the body at the side thereof opposite said cup.

12. The combination of claim 1 including one of the following attaching the cup to said body:

$x_1$) a clamp arm or arms, $x_2$) a flexible band, $x_3$) a pivot.

13. The combination of claim 1 including first and second said suction cups, spaced apart lengthwise of the body.

14. A hand-held illuminator apparatus comprising in combination:

a) an elongated body including a hand held section, b) a main light source carried by the body in spaced relation to the hand held section, c) circuitry in said body to supply electrical current to the light source, d) a suction cup on the body e) a lens carried by the body to face said light source, and having an exterior elongated surface which has generally circular curvature in cross sections normal to the direction of lens elongation, f) and suction cup support means embracing said body and lens circular curvature, whereby the lens and body may be rotated relative to said cup, located adjacent the lens.

15. The combination of claim 14 wherein said cup is carried on said hand held section to face away from the body exterior, and to support the body to hang at an angle offset from vertical.

16. The combination of claim 14 including at least one additional work assisting device removably attached to the body.

17. The combination of claim 14 wherein the suction cup is attached to said body in one of the following modes:

i) fixedly attached, ii) adjustably attached, iii) swingably attached, iv) detent attached.

18. The combination of claim 14 including one of the following attaching the cup to said body:

$x_1$) a clamp arm or arms, $x_2$) a flexible band, $x_3$) a pivot.

19. The combination of claim 1 wherein the cup consists of elastomeric material that has limited flexibility when attached to the support structure and characterized in that inadvertent deflection of the support body does not dislodge the cup and body from the support structure.

20. A method of attaching a hand held illuminator to support structure, the illuminator comprising:

a) an elongated body including a hand held section, b) a main light source carried by the body, c) circuitry in said body to supply electrical current to the light source, d) and at least one suction cup carried by said body to provide for positive releasable attachment of said illuminator to support structure, said method including:

e) adjusting said at least one suction cup relative to an elongated axis defined by said body and relative to said support structure to support gravitational forces exerted via said body to prevent inadvertent detachment of the body from said support structure, f) and providing for relative rotation of the body relative to the suction cup about an elongated axis defined by the body, and for shifting of the body in the direction of said axis and relative to the body, g) and effecting said rotation and shifting.

21. The method of claim 20 wherein said adjusting step includes adjusting the position of said cup both lengthwise of and about said elongated axis.

22. The method of claim 20 wherein said circuitry includes ballast positioned in said body to exert force acting on said cup when the body is attached via said cup to the support structure, and said adjusting step includes adjusting the position of said cup relative to said ballast to prevent detachment of the body from the support structure when light from said source is directed on work.

23. The method of claim 21 wherein said circuitry includes ballast positioned in said body to exert force acting on said cup when the body is attached via said cup to the support structure, and said adjusting step includes adjusting the position of said cup relative to said ballast to prevent detachment of the body from the support structure when light from said source is directed on work.

24. The method of claim 20 wherein said support structure comprises the raised hood of a vehicle to the underside of which the body is attached via said suction cup, or window glass, or a painted surface.

25. The method of claim 20 including also adjusting the apparatus body relative to the suction cup to effect needed directional illumination of work.

26. The method of claim 21 including adjusting the apparatus body both longitudinally and about said elongated axis, and relative to the suction cup attached to the support structure, to effect needed accurate illumination of work.

27. The method of claim 22 wherein the ballast includes multiple ballast sections spaced lengthwise of the body to exert gravitational forces at multiple locations, and said adjusting step includes adjusting the position of the cup relative to the ballast sections to prevent said detachment.

* * * * *